US006494925B1

(12) United States Patent
Child et al.

(10) Patent No.: US 6,494,925 B1
(45) Date of Patent: Dec. 17, 2002

(54) SCULPTURED PILE FABRIC HAVING IMPROVED AESTHETIC CHARACTERISTICS

(75) Inventors: Mary T. Child, LaGrange, GA (US); Frank W. Teaster, LaGrange, GA (US); Ronald Magee, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/483,480

(22) Filed: Jan. 14, 2000

(51) Int. Cl.[7] ..... D06P 7/00; D06P 5/22

(52) U.S. Cl. ..... 8/485; 8/478; 8/114.6; 8/497

(58) Field of Search ..... 8/114.6, 478, 485, 8/497

(56) References Cited

U.S. PATENT DOCUMENTS

| | | | | |
|---|---|---|---|---|
| 545,420 A | * | 8/1895 | Bamford | |
| 3,849,157 A | | 11/1974 | Palmer et al. | 117/11 |
| 3,856,598 A | | 12/1974 | Gregorian et al. | 156/85 |
| 3,945,791 A | | 3/1976 | Bohrn | 8/17 |
| 3,961,882 A | | 6/1976 | Vits et al. | 8/17 |
| 3,989,448 A | | 11/1976 | Bohrn | 8/14 |
| 4,147,507 A | * | 4/1979 | Laus | |
| 4,188,430 A | | 2/1980 | DeBarnard, Jr. et al. | 428/88 |
| 4,216,735 A | | 8/1980 | McDaniel, Jr. | 112/410 |
| 4,290,766 A | | 9/1981 | Burns, Jr. et al. | 8/491 |
| 4,323,612 A | | 4/1982 | van Issum | 428/89 |
| 4,353,706 A | | 10/1982 | Burns, Jr. et al. | 8/114.6 |
| 4,355,063 A | | 10/1982 | Palmer et al. | 428/89 |
| 4,415,331 A | | 11/1983 | Dusenbury et al. | 8/114.6 |
| 4,443,505 A | | 4/1984 | Ehrenfeld, Jr. | 428/89 |
| 4,589,884 A | * | 5/1986 | Gilpatrick | |
| 4,846,845 A | | 7/1989 | McBride et al. | 8/114.6 |

* cited by examiner

*Primary Examiner*—Margaret Einsmann
(74) *Attorney, Agent, or Firm*—Terry T. Moyer; Charlotte C. Wilson

(57) ABSTRACT

The present invention provides a sculptured pile fabric having both a printed pattern and a sculpted surface of various pile heights. The fabric of the present invention has improved aesthetic qualities as compared with sculptured products of the prior art. This improved sculptured fabric is the result of a chemical sculpting method, in which the height of the pile surface is selectively reduced in a pattern configuration, and that is followed by an overall "dilute" dyeing process. This "dilute" dyeing process is similar to that used to "tea stain" textile products, wherein an overall hue is imparted to a textile by the use of a relatively dilute (low concentration) dyestuff. The resulting sculptured product has an appearance that emphasizes the sculptured areas, making the sculptured areas appear to have greater depth, especially when viewed at a distance.

7 Claims, 2 Drawing Sheets

SCULPTURED PILE FABRIC HAVING IMPROVED AESTHETIC CHARACTERISTICS

TECHNICAL FIELD

The present invention relates to sculptured textile substrates, and specifically pile fabrics, and to a process for producing such fabrics. More particularly, the present invention relates to a sculpturing process wherein the tensile strength of the fibers comprising the areas of the fabric to be sculptured is reduced so that the pile may be more easily removed in those selected areas by mechanical means. The process further includes a color wash or dye treatment that may be applied to the fabric to enhance the visual impact of the sculptured areas and, where necessary, eliminate any undesired bleached effect often seen in areas adjacent to the sculptured areas as a result of the sculpturing process.

BACKGROUND

In the production of pile fabrics, it is often desirable to provide a sculptured effect on the surface thereof in order to enhance the decorative appeal. Several techniques have been used to create such a sculptured surface, although none of these techniques has been completely satisfactory.

One of the early attempts to achieve such a sculptured effect was by means of a heated embossing roll or plate which has been engraved or otherwise treated to create a desired design in raised relief on the surface of the pile fabric. When using a heated embossing roll, depth is created by the partial or complete melting of the embossed areas. However, fibers may lose their individual integrity and become bonded together, thereby often making the feel or hand of the embossed areas harsh and undesirable. More recent embossing techniques have not been completely successful in, overcoming these problems.

Other sculpturing methods that utilize chemical means to shrink the fibers are known. Those processes that employ a chemical shrinking agent to create the embossed areas have been generally unsatisfactory because the embossed areas tend to have a harsh and undesirable hand.

An alternative method of creating a sculptured fabric uses chemicals to dissolve, completely or partially, those fibers that come into contact with the chemical solution. Use of solvents to dissolve fibers in selected areas has been largely unsuccessful since the solvent may destroy the entire pile length in the areas to be embossed, thereby exposing the backing of the fabric, which may not be desired. Even if total dissolution of the pile is avoided, fiber integrity may be compromised and a harsh, undesirable hand may be the inevitable result.

A satisfactory sculpturing process is disclosed in U.S. Pat. No. 4,846,845 to McBride et al., which is herein incorporated, in its entirety, by reference. The process involves the selective carving of a pile fabric with a chemical fiber-degrading agent that may be incorporated as part of the fabric dyeing process. The pile fabric is then finished by heating, neutralizing the degrading agent, washing, and drying. Finally, the degraded fibers are removed by mechanical means to provide a sculptured pile fabric. Because the fiber-degrading agent is known to attack the dye components in areas adjacent to the sculptured portions as well as the areas to which it is directly applied, the resulting sculptured fabric made by this prior art process frequently has bleached "halo areas" immediately adjacent to the sculptured regions. When viewed from a distance, these halo areas can be more apparent than the textured portion of the sculptured fabric, thereby degrading the overall appearance of the patterned area. A method to make these halo areas visually less prominent, or eliminate them entirely, has heretofore been unknown.

The present invention provides such a method, which comprises applying a dilute dye solution over the entire substrate surface, thereby coloring both the sculptured portions and the non-sculptured portions, but to a different degree. The sculptured areas tend to be more receptive to this application of dilute dye than the non-sculptured areas. Somewhat surprisingly, the non-sculptured areas immediately adjacent to the sculptured areas tend to have an intermediate affinity for the dilute dye, i.e., the relative concentration of dye is greatest in the sculptured areas, least in the central regions of non-sculptured areas, and intermediate in those non-sculptured "boundary areas" immediately adjacent to the sculptured areas. The result of this overall dyeing step is a dramatic reduction in the visual prominence of any "halos" surrounding the sculptured areas. Additionally, this step has the unexpected effect of giving the appearance of a greater depth of sculpturing to the finished sculptured pile fabric. For these reasons, the present invention represents a useful advancement over the prior art. It should be noted that, as used herein, the term "fabric" is used in a broad sense, and is intended to include carpets and rugs, in addition to upholstery fabrics and the like.

SUMMARY

The present invention provides a sculptured pile fabric having both a printed pattern and a sculptured surface of various pile heights. The fabric of the present invention has improved aesthetic qualities as compared with sculptured products of the prior art. This improved sculptured fabric is the result of a chemical sculpting method, in which the height of the pile surface is selectively reduced in a pattern configuration, that is followed by an overall dyeing process involving the application of a dilute dye solution. This "dilute" dyeing process is similar to that used to "tea stain" textile products, wherein an overall shade is imparted to a textile by the use of a relatively dilute (low concentration) dyestuff. The resulting sculptured product has an appearance that emphasizes the sculptured areas, making the sculptured areas appear to have greater depth, especially when viewed at a distance.

DESCRIPTION OF THE PREFERRED EMBODIMENTS

This invention provides a process for sculpturing pile fabrics (which, optionally, may already be dyed or patterned), which, for previously unsculptured fabrics, comprises:

(a) selectively contacting the pile surface of a pile fabric corresponding to a pattern with a fiber degrading composition, said composition comprising a fiber degrading agent in a concentration sufficient to reduce the tensile strength of the fibers of the pile, and optionally selectively applying a first dye in pattern form and in registry with the fiber degrading agent;

(b) heating the pile fabric to temperatures above about 180° F., but below about 250° F. (preferably, using atmospheric steam), sufficiently to degrade the selected fibers of the pile and to provide fixation of the dyes;

(c) washing the pile fabric to remove any residual components of the fiber degrading composition from the pile fabric;

(d) mechanically removing the degraded pile fibers;

(e) neutralizing the fiber degrading composition with an acid-neutralizing solution containing, as a component, a composition selected from the group consisting of a hydroxide, carbonate, or phosphate of Group I and II metals;

(f) washing the pile fabric to remove any residual components of the acid-neutralizing composition from the pile fabric;

(g) applying and fixing a low concentration dye to the overall surface of the sculptured pile fabric;

(h) washing the sculptured, dyed pile fabric of step (g) and mechanically removing any remaining thickeners or excess dye chemicals; and (i) drying the pile fabric by any appropriate means.

This process, beginning with step (g), can also be used on any pile substrates that have been previously sculptured by chemical or other means.

Figure 1:
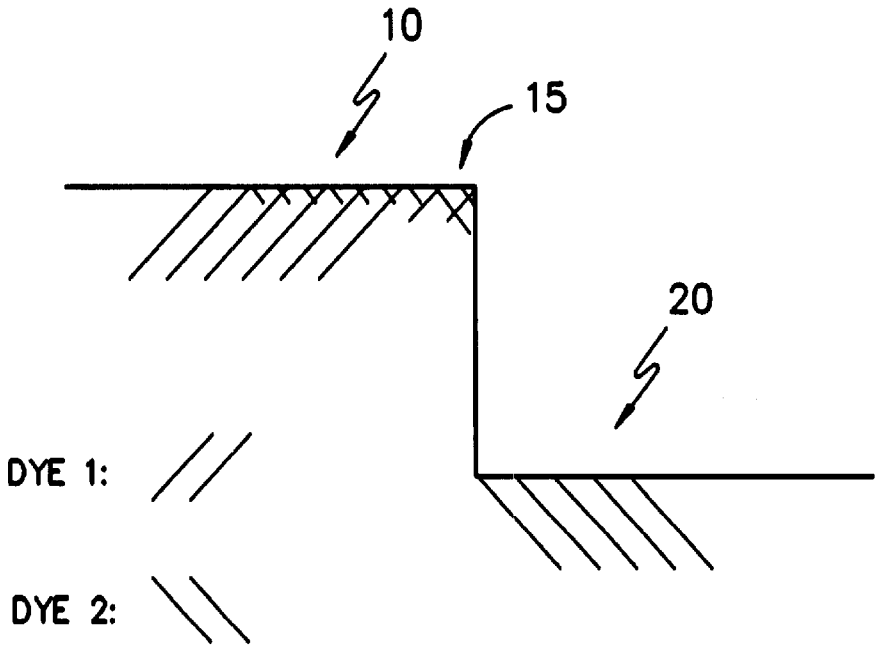
FIG. 1 is a schematic representation of the location and relative concentration of two dyes along a boundary between a first pile area and a second pile area on a fabric dyed in accordance with the teachings herein.

Turning now to the drawings, FIG. 1 is a representation of the relative locations and concentrations of two dyes along the boundary of a first pile area 10 and a second pile area 20. First pile area 10 has a pile height higher than the pile height of second pile area 20. The boundary area 15 shall be understood to mean the area that is part of first pile area 10 and that is immediately adjacent to second pile area 20. A first dye is indicated by forward slanting lines, and a second dye (which in this example may be a dilute dye) is indicated by backward slanting lines, as shown in FIG. 1. In addition, a substantially uniform, relatively high concentration of the first dye is present in first pile area 10, except in areas directly adjacent to second pile area 20, i.e., boundary area 15. Boundary area 15 has a relatively low concentration of the first dye and a relatively low concentration of the second dye. A substantially uniform, relatively high concentration of the second dye (relative to the concentration of the second dye in boundary area 15), which may be in dilute form, is present in second pile area 20.

Figure 2:
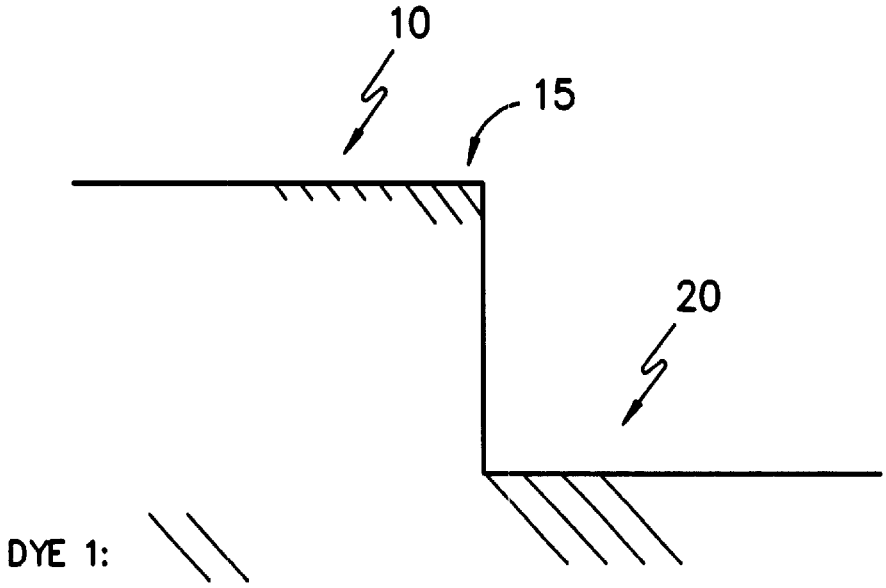
FIG. 2 is a schematic representation of the location and relative concentration of a single dye along a boundary between a first pile area and a second pile area on a fabric dyed in accordance with the teachings herein.

FIG. 2 is a representation of the relative locations and concentrations of a single dye along the boundary of a first pile area 10 and a second pile area 20, as would occur if the dilute dye application disclosed herein would be applied to a sculptured, but undyed, substrate. In this example, the first dye may be a dilute dye and is indicated by backward slanting lines. First pile area 10 has a substantially uniform, relatively low concentration of the first dye. Boundary area 15 has a concentration of the first dye that is intermediate between the concentration found in first pile area 10 and second pile area 20. Second pile area 20 has a substantially uniform, relatively high concentration of the second dye (relative to the concentration of the second dye in boundary area 15).

Figure 3:
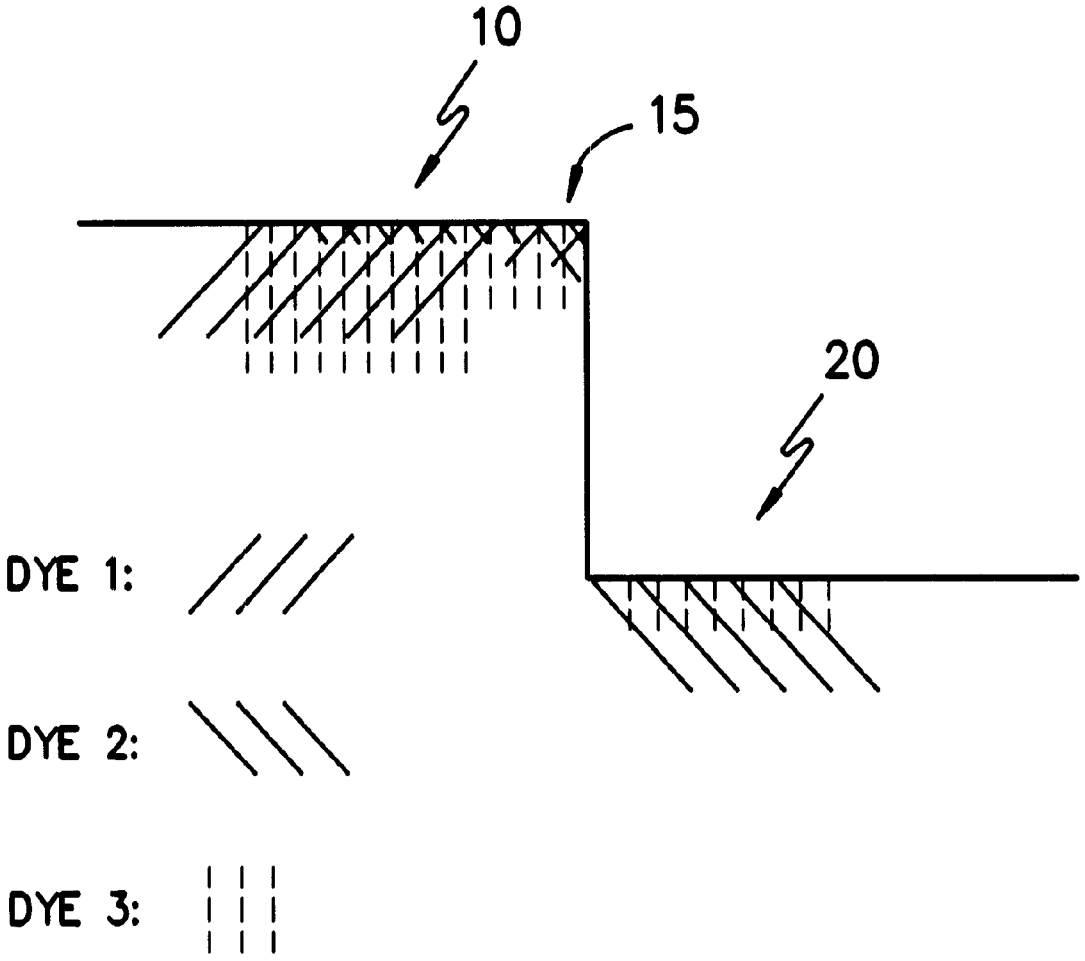
FIG. 3 is a schematic representation of the location and relative concentration of three dyes along a boundary between a first pile area and a second pile area on a fabric dyed in accordance with the teachings herein.

FIG. 3 is intended to show the effect of the present invention on a textile substrate that has been uniformly dyed prior to being patterned and sculptured. This representation shows the relative locations and concentrations of a first dye (represented by forward slanting lines), a second dye (represented by backward slanting lines), and a third dye (represented by vertical broken lines). First pile area 10 has a substantially uniform, relatively high concentration of the first dye, except at boundary region 15 wherein the concentration of first dye is reduced as a result of the effects of the migration of the sculpturing agent applied to second pile area 20. First pile area 10 has a relatively low concentration of the second dye (relative to second pile area 20) in boundary area 15 and has an even lower concentration of the second dye in areas outside boundary area 15. A similar situation exists in first pile area 10 with respect to the relative concentration of the third dye. Boundary area 15, as indicated, has intermediate concentrations of the first dye, the second dye, and the third dye, as a result of the migration of the sculpturing agent applied to second pile area 20, as discussed above. Second pile area 20 has a substantially uniform, relatively high concentration (relative to boundary area 15) of the second dye and a concentration of the third dye that is lower than that found in first pile area 10 or boundary area 15, reflecting the propensity of the sculpturing chemical to degrade any dye to which it comes into contact.

The textile substrates that may be processed according to the present invention include virtually all pile fabrics, and especially those used in floor coverings (carpets and rugs), upholstery, and other interior furnishing applications. Such fabrics may or may not have been dyed prior to the sculpturing step or the overall dyeing step. Examples of fibers that comprise the pile fabrics include synthetic fibers prepared from polyamides such as nylons that are well known to those skilled in the art, natural fibers such as wool, and blends of the foregoing examples. The preferred pile fabrics employed in the process of the invention include nylon and nylon-wool blends. The term "synthetic fibers," as employed herein, is intended to include any long chain polymeric amide that has recurring groups as an integral part of the main polymer chain and that is capable of being formed into a filament in which the structural elements are oriented in the direction of the axis of that chain.

Polyamide resins coming within the scope of the present invention are formed generally by reaction of the dicarboxylic acid with a diamine or by the self-condensation of an aminocarboxylic acid. Illustrative of these polyamide resins are nylon 6,6 (prepared by the condensation of hexamethylenediamine and adipic acid); nylon 6 (prepared by the self-condensation of epsilonamino caproic acid or caprolactum); as well as a variety of polymers prepared from polymerized dibasic acids and polyamine compounds. The preferred fibers are nylon 6, nylon 6,6, and wool blends with either of these two nylons.

The fiber degrading composition of the process is applied to the pile fabrics in order to produce the desired sculptured effect. The fiber degrading composition contains a fiber degrading agent as the primary active component of the composition. For purposes of discussion herein, the term "fiber degrading composition" may be defined as any active chemical compound or composition, which, when applied to the pile fabric, causes that portion of the pile to which it has been applied to become brittle or to realize substantial reduction in strength without actually dissolving the fiber. As a result, the degraded portion of the pile can be removed at a later stage in the process by conventional mechanical means. The composition should be capable of being substantially removed from the pile or at least neutralized in subsequent sculpturing steps. It should also be capable of increasing the affinity of the fibers in the sculptured areas for dye applied following the sculpturing step.

The fiber degrading agent should be present in the fiber degrading composition in a concentration sufficient to reduce the strength of the fibers so that the fibers may be removed by mechanical means after the application of heat. The concentration of the sculpturing agent should not be so high as to cause the complete destruction of the fiber integrity prior to the subsequent removal thereof by mechanical means. It has been found that the fiber degrading agent, which is preferably one or more of the isomers of toluene sulfonic acid, should be present in the fiber degrading composition in a preferred amount of from about 10 percent to about 70 percent by weight, and more preferably in an amount from about 15 to about 50 percent by weight, based upon the weight of the fiber degrading composition.

The fiber degrading agent is present in the fiber degrading composition together with a suitable diluent. The diluent may be a solvent or a solute for the fiber-degrading agent. If the agent is not soluble, the agent should be present in the composition in a finely pulverized form, that is, it should be present in a micro-pulverized form, which indicates particle diameter in the order of 100 microns or smaller, preferably even 20 microns or smaller. Such dispersion of the fiber-degrading agent will assure that the agent becomes uniformly dispersed on the desired portions of the fiber. The fiber degrading composition may preferably include predominant amounts of water as a solvent for the fiber-degrading agent, although other solvents (including methanol and ethanol) may be employed. In any event, it is believed that the alteration of the tensile strength of the fiber is caused by a hydrolysis reaction, which results in breakage of the bonds of the molecules that make up the fiber. For this reason, it is believed that hydrogen ions should be present at the site of the reaction together with the fiber-degrading agent, and this may be conveniently accomplished by using water as a solvent.

The composition may further include a thickening agent (e.g., natural and synthetic gums and cellulose derivatives) by means of which the viscosity of the composition may be varied in a manner well known in the art in order to obtain the viscosity characteristics demanded in some textile printing technologies. The characteristics exhibited by a composition of a certain viscosity enable the fiber-degrading agent to adhere to, and operate on, the fiber in order to generate a sculptured pattern. Further, if the composition had a low viscosity, it may be more likely to bleed or migrate into adjacent areas and compromise the clarity of the desired pattern. In general, the viscosity of the composition may preferably be from about 100 to about 1000 centipoise, at 25° C., as measured by a Brookfield No. 3 spindle at 30 rpm.

The fiber degrading composition may be applied to the pile fabric in an amount from about 50 percent to about 500 percent, preferably about 150 to about 250 percent, by weight based upon the weight of the area of the substrate to be sculptured. The fiber degrading composition may be applied to the pile fabric in the form of a substantially transparent composition so that the only visually apparent alteration of the product is the sculpturing effect. Without dyestuffs, the sculpting process results in an undyed or solid shade fabric, having a sculpted surface as depicted in FIG. 2.

Alternatively, and more preferably, the fiber degrading composition may be applied in registry with a dye or pigment composition used in printing the fabric, so that the color appears in perfect registry in areas adjacent to where the fiber degrading composition has been selectively applied (as shown in FIG. 1). Acceptable dyestuffs include acid dyes, acid premetallized dyes, acid milling dyes, dispersed dyes, direct dyes, and fiber reactive dyes. Viscosity and dye concentration should be controlled. The resultant effect is an embossed design in registry with the printed pattern.

With regard to the selected areas where the fiber degrading agent has been applied, the extent of pile removal (and hence the depth of sculpturing) may be controlled by varying the amount of fiber degrading composition applied, by varying the concentration of fiber degrading agent in the fiber degrading composition, or both. Furthermore, the amount of pile removed in the selected areas can also be controlled to a certain extent by the depth of penetration of the fiber degrading composition into the pile of the fabric. Penetration can be controlled by varying, for instance, the viscosity of the chemical fiber degrading composition.

Application of the fiber degrading composition to the pile fabric may be accomplished by utilizing one of the many types of known printing devices, thereby eliminating the need for expensive embossing or sculpturing equipment. Because the sculpturing is due to the removal of portions of the pile rather than the shrinkage of the pile in certain areas, the product typically has a much softer hand than would otherwise be provided for a given depth of sculpturing. Also, the product exhibits all of the advantages of products made by range printing techniques as opposed to woven fabric or hand sculptured fabric. The preferred apparatus for application of the fiber degrading composition may be a jet dyeing apparatus such as that disclosed in U.S. Pat. No. 4,084,615 to Norman E. Klein and William H. Stewart and U.S. Pat. No. 4,984,169 to Harold L. Johnson, Jr., both of which are assigned to Milliken Research Corporation, the disclosures of which are herein incorporated by reference. Other acceptable, but perhaps less preferred application methods, include the Chromojet™ printing apparatus by Zimmer, any screen printing apparatus, and any other printing apparatus, which are capable of selectively applying dye or chemical compositions to a fabric substrate.

After the fiber degrading composition has been applied to the pile fabric, the fabric is heated to a temperature sufficient to cause a substantial reduction of the tensile strength of the fibers. Heating also affixes the dyestuffs, which, optionally, may also have been applied. Although the temperatures from about 120° F. to about 250° F. may be employed, atmospheric steaming conditions, using temperatures above about 180° F. to about 212° F., are preferred.

Generally, the pile fabric may be subjected to heating for a time sufficient to cause degradation of the selected portions of the pile fabric. Where the heating means is steam, it has been found that heating should be for at least one minute, preferably about three to about 30 minutes. The time for heating should be adjusted to result in the desired degree of degradation for the particular fiber substrate. Thus, if the time of treatment is too short, insufficient degradation will occur to allow for subsequent removal of the pile by mechanical means. If the time is too long, the pile may completely decompose resulting in an undesirable product having either no residual pile in the treated areas or an unpleasant hand in the embossed areas.

Following heating, the pile fabric is then washed in water of ambient temperature (say, for example, about 75° F.), in order to remove any residual components of the fiber degrading composition.

As mentioned above, the selected areas of the pile fabric to which the fiber-degrading agent has been applied may be removed by mechanical means. Mechanical action to cause such removal may be initiated or accomplished totally during the washing step described above by simply spraying the washing solution onto the entire surface of the substrate at a high velocity. Alternatively, the mechanical means by which the degraded portions are removed may be a simple beater, which applies such action to the entire surface of the fabric from which the degraded fibers are to be removed. A preferred means for removal is a vacuum system, such as the Spray-Vac system manufactured by E-Vac, in which water is sprayed onto the fabric and then vacuumed off the fabric. In general, the degree of mechanical action required, and the preferred means used, will depend upon the resultant tensile strength of the fiber after degradation in the areas to be sculptured. Mechanical removal of the degraded pile may be performed during the washing step as mentioned above or alternatively after washing but prior to drying of the fabric.

After washing but prior to drying (and preferably after mechanical removal), the pile fabric is preferably neutralized with an acid-neutralizing solution containing, as a component, a composition selected from the group consisting of a hydroxide, carbonate, or phosphate of Group I and II metals. To halt the activity of the fiber degrading agent, this step in the process has been found to be important in (a) preventing further degradation of the fiber of the pile fabric during the lifetime of the finished pile fabric and (b) minimizing the loss of color in areas immediately adjacent to the sculptured areas (i.e., boundary areas), due to the action of residual quantities of the fiber degrading agent. The pile fabric may then be washed to remove the components of the fiber degrading composition from the pile fabric.

It is known that the fiber-degrading agent is capable of causing dye degradation in the areas adjacent to the selectively treated areas. To address this undesirable degradation, an additional dye application is utilized that eliminates the effects of dye degradation caused by the fiber-degrading agent. This dye application can be thought of as a "tea stain" process, in which a dilute dye (that is, a dye having a low concentration) is applied uniformly over the entire substrate. The fibers in those areas in which the fiber degrading composition has been applied show a greater affinity for this dilute dye than do the fibers of the non-sculptured areas. Since the relative dyeability of fibers in the sculptured areas is increased, the appearance of the sculpturing effect is emphasized, making the sculpturing more visually apparent, especially when viewed from a distance. Acceptable dyestuffs include those that may have been used in the patterned dyeing process, namely, acid dyes, acid premetallized dyes, acid milling dyes, dispersed dyes, direct dyes, and fiber reactive dyes. For purposes of explanation, the dilute dye shall be referred to as the second dye, because in many cases it will be the second dye to be applied to the substrate. However, as mentioned hereinabove, the fabric prior to the sculpturing step may already be dyed in a solid shade or in one or more colors in a pattern configuration, or the fabric may be sculptured and undyed.

The second dye is applied to the pile fabric by means of a solid shade applicator, an overflow applicator, a chem-pad or nip applicator, a foam applicator, a Chromojet™ printing apparatus by Zimmer, the printing apparatus described in U.S. Pat. Nos. 4,084,615 and 4,984,169, or any other appropriate dyeing or chemical applicator known to those of skill in the art. The second dye can be applied in a hot form, so as to be instantly fixed, or can be applied at an ambient temperature and fixed in a subsequent step with heat or steam. In fixing, temperatures from about 120° F. to about 250° F. may be employed, although atmospheric steaming conditions, using temperatures from about 180° F. to about 212° F., are preferred. With steam heating, it has been found that heating should be for at least one minute, preferably about two to about five minutes. Alternatively, infrared heating may be used for the period of time necessary to achieve a fabric surface temperature of about 120° F. to about 200° F.

Following heating, the pile fabric is then washed, in order to remove any residual components of the second dye. It may also be desirable, at this time, to mechanically remove any residual chemical or fiber components that may be present in the fabric.

Finally, the sculptured, printed pile fabric is dried, according to conventional techniques. Specifically, the fabric may be dried at a temperature in the range of about 220° F. to about 310° F., and preferably in the range of about 230° F. to about 260° F. Effective drying times have been found to be in the range of about three to fifteen minutes. Any appropriate means of drying the fabric may be used, including, but not limited to, drying by evaporation or by infrared or microwave sources.

A large number of products can be produced by the process of the present invention. The products can be used for floor, wall, and ceiling coverings, drapery, upholstery, apparel, and the like, and, in fact, wherever pile fabrics are utilized. They are readily adaptable to decorate any surface on which the pile fabrics can be placed or fitted. Many additional applications will occur to those skilled in the art.

The following examples are provided for illustrative purposes only and are not to be construed as limiting the subject matter of the invention in any way. Unless otherwise indicated, all parts and percentages are by weight.

EXAMPLE 1

In this example, the process was performed on a tufted carpet comprised of 100% DuPont Filament, Stainmaster ™ nylon 6,6, type 896AS, Semi Dull, Trilobal, 17dpf. The carpet had a ⅛ inch tufting gauge, a weight of 40.0 ounces per square yard, and a construction in which the nylon 6,6 yarns were tufted into a woven polypropylene back.

The carpet was first wetted to approximately 70% based on the dry weight of the carpet (hereafter referred to as percent dry basis), with a Cationic Polymer Solution to enhance the print color of the dyeing of the carpet. A fiber degrading composition was then applied, at approximately 250% dry basis, to preselected areas of the carpet. Several different colors of a conventional aqueous acid dye solution were then applied to the remainder of the carpet to create a printed carpet. The application of the fiber degrading composition and the acid dye solution was by means of the apparatus described in U.S. Pat. Nos. 4,084,615 and 4,984,169.

The fiber degrading composition was composed of Xanthan gum in sufficient amount to effect a viscosity of approximately 450 centipoise (as read by a Brookfield II viscometer, No. 3 spindle at 30 rpm), 2 weight percent mineral oil ("Ortholube," available from Milliken Chemical, a division of Milliken & Company), and a fiber-degrading agent having a concentration of approximately 38% paratoluene sulfonic acid. The aqueous acid dye solutions consisted of Xanthan gum in sufficient amount to effect a viscosity of approximately 450 centipoise and acid premetallized dyes varying in concentration from about 0.5% to about 3% depending on the color and depth of the different shades.

The carpet was then steamed at about 212° F. for 8 minutes to activate the reaction between the fiber and the sculpturing liquor and to fix the dye. It was then washed with water at ambient temperature (about 75° F.) and vacuumed to remove any degraded fibers, chemicals and thickening agents present on the fabric. To neutralize any unreacted fiber-degrading agent, the carpet was then run through a wash bath with a pH controlled to 10 S.U. by addition of a 50% sodium hydroxide solution. The carpet was then washed and vacuumed again to remove any additional dyeing and neutralizing chemicals.

With an overflow applicator, an aqueous acid dye solution was then applied to the entire carpet substrate at 350% dry basis. The aqueous acid dye solution consisted of Xanthan gum in sufficient amount to effect a viscosity of approximately 40 centipoise, 0.2% by weight of a surfactant for wetting, 0.5% by weight of a defoamer, and 0.01% by weight of acid dyes. The carpet was conventionally steamed for 3 minutes to fix the dye. The carpet was washed and vacuumed once more to remove the thickener and excess dye chemicals from the over flow dyeing and conventionally dried at 280° F.

During and after the process the following observations were made:

(1) There was no reduction in pile height in the sculpturing areas or weight loss observed prior to steaming.

(2) A reduction of about 20 to 30 percent in pile height in the sculptured area was observed after steaming. In these areas, the fiber integrity was not altered, but the fiber strength was dramatically reduced.

(3) After the washing and neutralizing steps, approximately 70 percent of the pile was removed in the pre-selected sculptured areas.

(4) Before the over-dyeing step, the sculptured areas were white, and the dye around the sculptured areas exhibited a slight bleached effect where the dye had been degraded.

(5) The over-dyeing step dyed the white areas, covered the bleached effect and enhanced the texturing effect making it more visually prominent when viewed at a distance.

EXAMPLE 2

Example 1 was repeated except that the carpet was dyed with a solid shade applicator (a Fluid Dyer manufactured by Kusters) before the application of the fiber degrading composition and the print pastes. The printed dyes were weaker and appeared more washed-out, and the sculptured areas appeared lighter than the rest of the carpet.

EXAMPLE 3

Example 1 was repeated except the carpet was not dyed overall in-line, but instead was dried, rolled up, and taken through a dye range to apply the overall dye with the solid shade applicator of Example 2. The results were the same as in Example 1.

What is claimed is:

1. A process for creating a sculptured textile substrate having a pile surface, said surface being comprised of a first pile area having a first pile height, a second pile area having a second pile height, and a boundary area that is part of said second pile area and that is immediately adjacent to said first pile area, wherein said process results in said first pile areas that are visually distinct from said second pile areas and wherein said process reduces the visual prominence of said boundary areas, said process comprising the steps of:

(a) selectively contacting said pile surface in a patternwise application with a fiber degrading composition, said composition comprising a fiber degrading agent sufficient to reduce the tensile strength of said pile fibers in a first pile area;

(b) optionally, selectively applying a first dye to said first pile area in registry with said fiber degrading composition of step (a);

(c) heating said textile substrate to a temperature sufficient to degrade said fibers in said first pile area to which said fiber degrading composition has been applied;

(d) mechanically removing said fibers in said first pile area which have been degraded by said fiber degrading composition, thereby making the height of said first pile area less than that of said second pile area to which said fiber degrading composition was not applied;

(e) treating said pile surface with a neutralizing solution to neutralize said fiber degrading composition;

(f) overdyeing the entire textile substrate by uniformly applying and fixing a dye onto said first pile area and said second pile area, including said boundary areas, wherein said first pile area preferentially accepts more of said dye than said second pile area;

(g) washing said textile substrate; and (h) drying said textile substrate.

2. The process of claim 1 wherein said pile surface is subjected to dyeing with one or more colors before step (a).

3. The process of claim 1 wherein said pile surface is washed after neutralizing.

4. The process of claim 1 wherein said dye applied in step (f) is fixed by subjecting said pile surface to temperatures in the range of about 120° F. to about 250° F.

5. The process of claim 4 wherein said dye applied in step (f) is fixed by subjecting said pile surface to atmospheric steam conditions and temperatures in the range of about 180° F. to about 212° F.

6. The process of claim 1 wherein said dye applied in step (f) is fixed by subjecting said pile surface to infrared heat for a time required to obtain a temperature on said pile surface that is in the range of about 120° F. to about 200° F.

7. The process of claim 1 wherein said textile substrate is subjected to mechanical removal of thickeners and dye chemicals after step (g).

* * * * *